US005536275A

United States Patent [19]

Bohrer

[11] Patent Number: 5,536,275

[45] Date of Patent: Jul. 16, 1996

[54] METHOD FOR THE PRETREATMENT OF COTTON-CONTAINING FABRIC

[75] Inventor: Egon S. Bohrer, Coesfeld, Germany

[73] Assignee: Thies GmbH & Co., Coesfeld, Germany

[21] Appl. No.: 343,683

[22] Filed: Nov. 22, 1994

[30] Foreign Application Priority Data

| | | | |
|---|---|---|---|
| Apr. 12, 1994 | [DE] | Germany | 44 12 342.6 |
| Oct. 1, 1994 | [DE] | Germany | 44 35 256.5 |
| Oct. 26, 1994 | [DE] | Germany | 44 38 241.3 |

[51] Int. Cl.[6] ..... D06L 1/00; D06L 3/02

[52] U.S. Cl. ..... 8/111; 8/107; 8/137; 8/139; 8/158; 252/301.21; 510/303; 510/339

[58] Field of Search ..... 8/107, 110, 111, 8/138, 139, 137, 158, 147; 252/301.21, 95, 103, 94, 89.1

[56] References Cited

U.S. PATENT DOCUMENTS 4,725,281 2/1988 Stehlin et al. ..... 8/111

FOREIGN PATENT DOCUMENTS 3721765 1/1989 Germany .

*Primary Examiner*—Prince Willis, Jr.
*Assistant Examiner*—Alan D. Diamond
*Attorney, Agent, or Firm*—Meltzer, Lippe, Goldstein et al.

[57] ABSTRACT

The present invention relates to a method for the pretreatment of a fabric containing cotton, in which the fabric is treated in at least one pretreatment bath for a predetermined period of time at an increased temperature and subsequently washed or neutralised. The treatment of the fabric in the pretreatment bath is performed at a temperature of more than 102° C., particularly at a temperature between 120° C. and 140° C.

12 Claims, 4 Drawing Sheets

METHOD FOR THE PRETREATMENT OF COTTON-CONTAINING FABRIC

The present invention relates to a method for the pretreatment of a cotton-containing textile fabric with the features of the generic part of claim 1.

In order to finish textile fabrics, for instance yarns, woven fabrics or knitted fabrics, it is required, that such fabrics are subjected to a pretreatment procedure. This pretreatment procedure produces the removal of such materials accompanying fibres which are usually found in cotton-containing fabrics, like in particular fats, waxes, burs or hulls or other accompanying agents which have been applied to the cotton-containing fabrics for the processing, like in particular slashing agents, oiling agents, lubricants, coning oils, carding oils, or the like.

The removal of the aforementioned fibre accompanying materials from cotton-containing fabrics can be performed continuously or discontinuously. For instance several pad-roll-methods are known, in which in particular cotton-containing fabrics in the shape of an open width are soaked with a particular pretreatment liquor which is washed off after a predetermined period of time, which is usually a few hours. According to the discontinuous treatment, particular batches of cotton-containing fabrics are brought into certain devices, which are usually standard dyeing devices and are superfused or perfused with a pretreatment bath. Treatment periods between about two hours and four hours and treatment temperatures below the boiling point of water, preferably up to a maximum of about 95° C., are used for the removal from the cotton-containing fabrics of the aforementioned natural fibres accompanying materials or such which have been applied during processing (natural waxes, fats, burs, hulls, slashing agents, oiling or the like).

The known pretreatment methods described above provide the disadvantage that they are relatively time-consuming.

It is the aim of the present invention to provide a method for the pretreatment of a cotton-containing fabric of the indicated type, which requires particularly little time to be performed.

This aim is reached by a method according to the characterising clause of claim 1.

As in the previously described known methods, the inventive method for the pretreatment of a cotton-containing fabric requires the pretreatment of the fabric in at least one pretreatment bath for a predetermined period of time at an increased temperature. Subsequently the pre-treated fabric is rinsed and/or neutralised while fresh liquor is being added. Differing from the known methods the treatment in the pretreatment bath of the fabric according to the invention is performed at a temperature of more than 102° C., preferably at a temperature above 115° C. and in particular in a temperature range between 120° C. and 140° C.

It could surprisingly be observed, that the inventive method, which may also be specified according to the usual textile terminology as a high-temperature-method (HT-method) led to satisfactory pretreatment results, notwithstanding a significant reduction of the treatment period. These pretreatment results are in particular characterised by an excellent hydrophilicity and an increased absorptive capability of the pre-treated cotton-containing fabric. As a result, for instance cloth which is treated discontinuously (batch-like) according to the inventive method, can be finished further, in particular by a dyeing or printing step in a perfect manner.

The inventive method provides additional advantages. It could be observed, that the aforementioned temperature increase to a value of more than 102° C., preferably to a value above 115° C. and in particular to a value between 120° C. and 140° C. and preferably to a value of 130° C. led to substantially faster and more intensive kier scouring, boiling off and bleaching, without any damage of the fibres in the cotton-containing fabric. Rather it was observed, that in comparison with the standard methods for boiling off, kier scouring and bleaching, performed at a temperature below 95° C., there was remarkably less reduction of the DP-value. This phenomenon is thought to be due to the fact, that the inventive method uses a significantly shortened treatment period, particularly to about 50% of the usual treatment period. As a consequence of this, the inventive method provides in comparison with standard known treatments a saving in energy and water in the order of magnitude of about 20% to about 50%, whereas the use of chemicals in the inventive method is reduced between 20 and 30% as well compared to a standard method. Also the inventive method allows the perfect removal of dead cotton and hulls in spite of the relatively short period the material stays at the final temperature (above 102° C.), which leads to an excellent degree of whiteness in the cotton-containing fabric treated according to the inventive method.

The improved degree of extraction (degree of removal) of the aforementioned natural fibre accompanying materials by the inventive method, has as a further consequence, that the cotton-containing tissue treated according to the inventive method, provides a softer, smoother and particularly more pleasantly falling touch and feel. Furthermore it is possible, by the use of the inventive method in sized woven fabric to perform the required desizing at the same time with a bleaching, which involves a significant reduction in cost, energy, water and chemicals.

Figure 1:
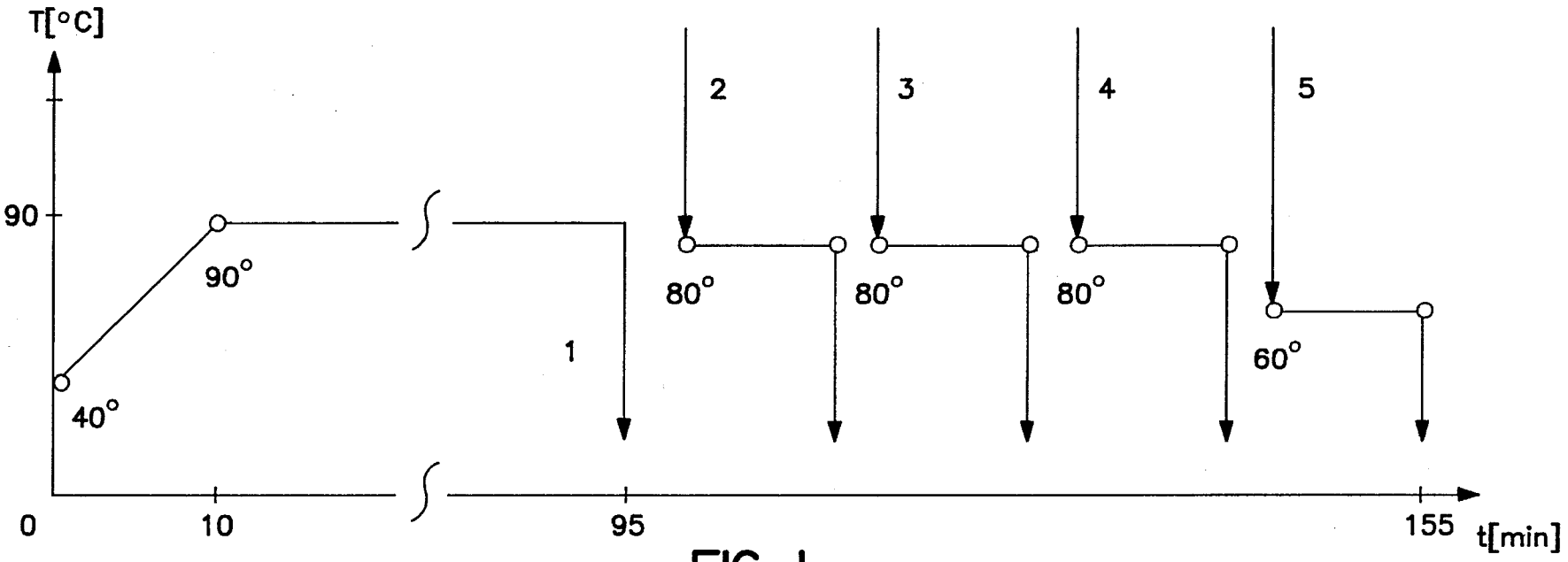
FIG. 1 PRIOR ART
FIG. 1 is a Temperature vs. Time graph for a standard boiling off/bleaching process for cotton yarn.

A particularly economic embodiment of the inventive method provides the treatment of the fabric in a single pretreatment bath. In other words, such an embodiment of the inventive method combines the step of boiling off and/or the kier scouring step and in the case of woven fabric the desizing step with the bleaching step, so that according this embodiment the boiling off, kier scouring, eventually desizing and bleaching are performed in a one-step and one-bath method. The consequence of this variation is a further reduction in the time required and additional economic advantages.

To enable the previously described advantages of the inventive method, another embodiment of the inventive method provides the presence in the pretreatment bath of an alkali source, preferably sodium hydroxide, a bleaching chemical, preferably hydrogen peroxide, a stabilizer, preferably an organic stabilizer, optionally a wetting agent, a fluorescent brightener and/or a detergent. The aim of the aforementioned alkali source is the chemical hydrolysis of the materials accompanying the fibres in the cotton-containing fabric to be treated, or to render them in a soluble form. The role of the bleaching chemical (agent), in particular the hydrogen peroxide, is the support of this process and apart from that, the oxidative bleaching and removal of coloured components. This oxidative process is regulated by the stabilizator, in particular the organic stabilizator, in such a way, that a spontaneous or locally limited disintegration of the bleaching chemical, in particular the hydrogen peroxide, is avoided, whereas the wetting agent and/or detergent guarantees on the one hand a wetting of the fabric and on the other hand allows the removal of the chemically changed fibre accompanying materials (hydrolysed, oxidatively destroyed or brought into a salt form) and/or the removal of the fibre accompanying materials soluble in the pretreatment bath.

In particular, when a fabric is bleached according to the inventive method, which shall provide a high degree of whiteness, it is recommended, to add to the pretreatment bath described before, a fluorescent brightener.

The concentration of sodium hydroxide, hydrogen peroxide, stabilizer, wetting agent, fluorescent brightener and/or detergent according to the inventive method depends on the type of fabric to be treated, the treatment temperature, the aggregate used, the bath ratio and the concentration of the fibre accompanying materials. Usually the pretreatment bath used according to the inventive method contains between 0.5 ml/l and 5 ml/l sodium hydroxide, preferably in a concentration between 25° Bé and 38° Bé, between 1.5 ml/l and 10 ml/l hydrogen peroxide in a concentration between 30% by weight and 35% by weight, between 0.2 g/l and 3 g/l of the organic stabilizer and between 0.1 g/l and 3 g/l of the wetting agent and/or detergent.

The bath ratio used at the inventive method for the treatment of fabric depends on the way the cotton-containing fabric to be treated is prepared. Usually this bath ratio (mass of fabric: mass of treatment liquor) varies between 1:2 and 1:20, preferably between 1:5 and 1:15. If for instance a yarn is treated according to the inventive method, then the bath ratio amounts to between 1:2 to about 1:8, whereas for the treatment of a cloth (woven fabric, knitted fabric) as a rope or as an open width fabric it is preferred to select a bath ratio of between 1:5 and 1:15.

The treatment period of the cotton-containing fabric at the treatment temperature of more than 102° C., in particular in the temperature range between 120° C. and 140° C., preferably at more than 130° C., lies according to the inventive method between 3 and 30 minutes, in particular between 5 and 15 minutes. It could be observed, that such short treatment periods are usually quite sufficient, to achieve the wanted, aforementioned positive treatment results ( for instance the high absorption capacity, high degree of whiteness, good wettability, good degree of desizing, little fibre damage, soft touch and feel).

According to a particularly advantageous embodiment of the inventive treatment the treatment of the cotton-containing fabric in the pretreatment bath is started at an initial temperature between 30° C. and 50° C. Subsequently this pretreatment bath is heated to a first temperature between 70° C. and 95° C. with a heating rate of 1.5° C./min to 6° C./min, preferably with a heating rate between 2.5° C./min and 3.5° C./min. Hereafter the temperature of the pretreatment bath is further increased with a heating rate between 0.5° C./min and 4° C./min, in particular with a temperature increase between 2° C./min and 3° C./min, to a final temperature of more than 102° C., preferably to a value above 115° C. and in particular to a final temperature between 120° C. and 140° C. and preferably to a final temperature of about 130° C. This embodiment of the inventive method warrants that the step concerning the boiling off, kier scouring, optionally desizing and bleaching is performed within the shortest possible time.

In order to further reduce the fibre damage at the previously described embodiment of the inventive method, a particularly advantageous embodiment provides the addition of the bleaching agent during the heating of the pretreatment bath from the initial temperature to the first temperature according to a predetermined addition rate, which means a controlled addition of the bleaching chemical depending on time. This addition rate can be adjusted in such a manner, that per unit of time a constant amount of bleaching agent is added, or with progress in time a decreasing amount of bleaching agent is added.

Certainly it is possible as well, to add all or a part of the aforementioned chemicals or the respective additional agents to the pretreatment bath before the pretreatment bath is heated.

It is particularly suitable, when in the previously described embodiment of the inventive method the predetermined addition of the bleaching agent is performed to according to a progressively increasing addition rate, meaning that in the course of time the amount of bleaching agent is increasing. This embodiment of the inventive method so leads to a particularly small reduction of the DP-value, which means that the fibre damage is correspondingly reduced. The DP-value ("Durchschnitts-polymefisationsgrad": average degree of polymerisation) represents a measure for the damage of the cotton caused by the respective treatment. It is an indication for the number of glycosidic bonds in the cellulose (cotton), which were ruptured by the treatment. The determination of the DP-value is performed under standardised conditions.

To achieve at the inventive method a further shortening of the treatment (boiling off, desizing, kier scouring, bleaching) another embodiment of the inventive method provides that the pretreatment bath is drained off after the completion of the treatment at a temperature of the bath above 102° C., in particular at the selected final temperature of the treatment, which is usually called according to the textile terminology a HT-drainage.

As has been described before, the pre-treated fabric is rinsed preferably between one and four times after the removal of the pretreatment bath. This rinsing duration can be shortened, when the rinsing liquor contains acid, preferably acetic acid or formic acid, in order to lower the pH-value of the treated fabric to a value in the range between 4 and 9.

Another embodiment of the inventive method provides, that the pretreatment bath is continuously diluted with such quantities of cold rinsing liquor and/or rinsing liquor preheated to a predetermined temperature so as to achieve a cooling down of the fabric according to a predetermined cooling rate, which means a controlled cooling of the pretreatment bath depending on time. In this embodiment of the inventive treatment the pretreatment bath is diluted with a constant, increasing or in particular decreasing quantity of cold rinsing liquor and/or rinsing liquor preheated to a predetermined temperature, so avoiding a time- and water-consuming liquor exchange. It is particularly suitable to cool the fabric to a final temperature between 90° C. and 50° C., in particular to a final temperature between 80° C. and 60°

C. This above described embodiment is called hereafter as rinsing with dilution.

In order to avoid the unwanted generation of folds (wrinkles) in such fabric which is present as a cloth and which are treated as a rope, it is suitable to perform the previously described rinsing with dilution. It is recommendable, to cool the fabric down to final temperatures between 90° C. and 70° C., the cooling rate varying between 1° C./min and 3.5° C./min.

In order to improve the efficacy of the removal of the fibre accompanying materials, it is recommended, at the same time during the dilution of the pretreatment bath with cold and/or preheated rinsing liquor to drain off the diluted, fibres accompanying materials containing liquor. In particular, when the quantity of the rinsing liquor (cold or preheated) which is added for the dilution of the pretreatment bath is identical with the quantity which is drained off as soiled (contaminated) liquor, it is possible to accomplish rinsing effects, which can in usual methods only be obtained by a repeated exchange of the rinsing bath (four to six times). This means, that this embodiment of the inventive method leads to significant reductions in the required quantity of water, the required energy and the resulting quantity of waste water.

According to a further embodiment of the inventive method, derived from the embodiment described above, the heating of the added rinsing liquor is performed by using the heat energy available in the soiled liquor containing the fibre accompanying materials. This can be obtained by leading both liquors over a heat exchanger, preferably according to a countercurrent system. According to this method it is possible to transfer about 60% to about 85% of the heat energy in the drained-off liquor to the added rinsing liquor.

Depending on the degree of contamination of the pretreatment bath at the end of the previously described rinsing by dilution the treated fabric can then be processed without further rinsing or may be rinsed after exchange of the rinsing liquor for fresh liquor once again in said fresh rinsing liquor. A third possibility provides another embodiment of the inventive method, that after the predetermined cooling temperature has been reached, the fabric undergoes further rinsing after the previously described rinsing by dilution, preferably for about 5 minutes to about 15 minutes. For this purpose further rinsing liquor is added and further contaminated liquor is drained off, in such a manner, that the level of the liquor in the treatment container stays the same.

It is possible to perform the treatment according to the inventive method faster, by adding after bleaching during and/or after the cooling down of the pretreatment bath, a reducing agent, preferably at a concentration between 0.3 g/l to 1 g/l. It is a good choice to use the commercially available Rongalit C (produced by the company BASF). By this treatment it is achieved, that the remaining part of the bleaching chemicals is destroyed by reduction and that damage to the fabric to be bleached is avoided.

In order to treat a fabric with a particularly high degree of whiteness, it is a good choice, to add at least one fluorescent brightener in particular to the pretreatment bath used for the bleaching step and/or to the rinsing liquor added after the bleaching. The concentration of said brightener should vary between 0.2 g/l and 3 g/l.

The term cotton-containing fabric used here is to include all substrates which are made completely or partially of cotton, in particular also mixtures of cotton and synthetic fibres, the synthetic fibre preferably being polyester (polyethylene terephtalate).

As it has already been stated repeatedly, the inventive method is particularly suited for the desizing, kier scouring or boiling off and bleaching of cotton-containing woven fabric according to a one-bath process or washing, kier scouring or boiling off and bleaching of knitted fabric or cotton-containing yarn according to a one-bath process.

Preferred embodiments of the invention are indicated in the subclaims.

The inventive method is illustrated hereafter with two examples.

EXAMPLE A

A cotton yarn was boiled off and bleached using a standard yarn-dyeing machine at a bath ratio of 1:5 according to a standard process. The pretreatment bath used had the following composition:

1 g/l organic stabilizer, 3 ml/l sodium hydroxide solution, 38° Bé, 0,5 g/l of a usual wetting agent and 5.5 ml/l hydrogen peroxide, 35%.

The temperature curve in dependence of time of the standard boiling off/bleaching process is shown in FIG. 1, wherein the numeral 1 denotes draining off of the pretreatment bath, the numerals 2–4 denote the first to third additions of rinsing liquor, and the numeral 5 denotes addition of neutralizing liquor (acetic acid).

After the boiling off/bleaching a rinsing step was performed three times at a bath ratio of 1:5. Hereafter the boiled off and bleached cotton yarn was brought with acetic acid to a pH value of 4.5. The total duration of the treatment was 155 minutes.

A second batch of the previously described cotton yarn was subjected to a kier boiling and bleaching treatment on the same device using the same bath ratio at a temperature of 130° C. The same pretreatment bath as described above was used, with the difference that hydrogen peroxide was added progressively during the heating period of the pretreatment bath from 40° C. to 90° C. The total amount of hydrogen peroxide required was 25% below the total amount of hydrogen peroxide which is required at a standard method.

After the boiling-off/bleaching one rinsing step and one treating step with acetic acid was performed to adjust the pH-value in the aforementioned way.

Figure 2:
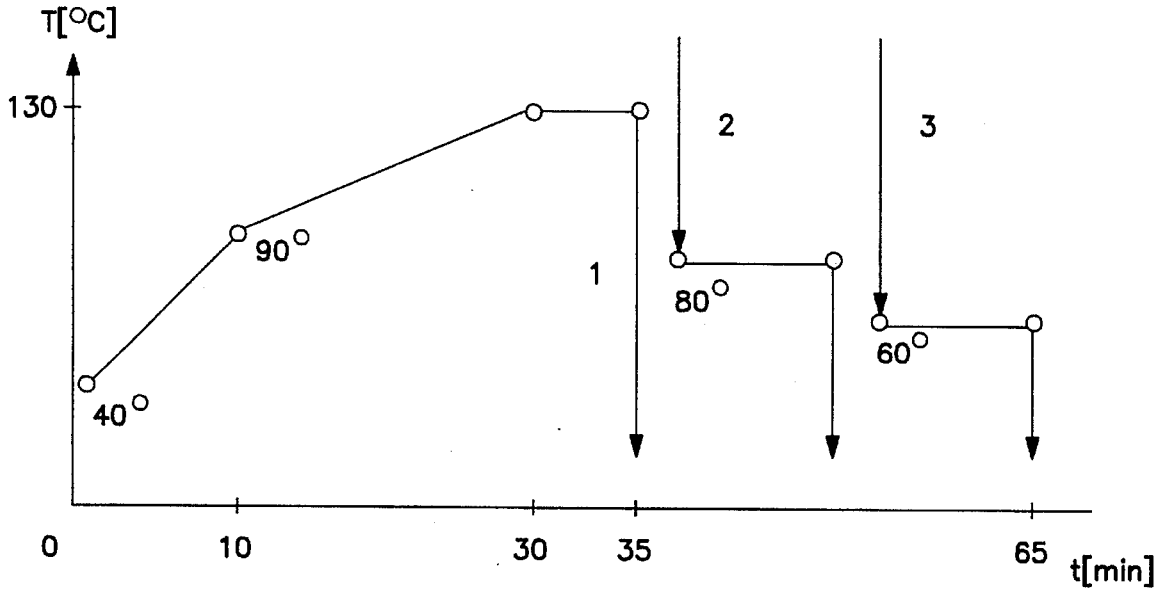
FIG. 2 is a Temperature vs. Time graph for an inventive embodiment of a boiling off/bleaching process for cotton yarn.

The development of the temperature with time during the kier scouring/bleaching treatment is depicted in FIG. 2, wherein the numeral 1 denotes draining off of pre-treatment bath, the numeral 2 denotes addition of rinsing liquor, and the numeral 3 denotes addition of neutralizing liquor (acetic acid). The total treatment period was 65 minutes.

Both yarns were knitted to a cloth, so that the degree of whiteness could be measured according to Berger. In addition the DP-value of the initial material and the two treated samples was measured. The results of these observations are shown in table 1.

TABLE 1

| | degree of whiteness according to Berger | DP value |
|---|---|---|
| initial material, unbleached | 38 | 2,468 |
| initial material, bleached by standard method, 90° C. | 76 | 1,870 |
| initial material, progressive | 94 | 2,280 |

TABLE 1-continued

| | degree of whiteness according to Berger | DP value |
|---|---|---|
| $H_2O_2$ addition, bleached at 130° C. | | |

EXAMPLE B

A cotton tissue with a weight per square meter of 160 g was boiled off and bleached in a standard dyeing device using a bath ratio of 1:5 as a rope.

The transport speed of the rope was 4 to 6 cycles per minute.

A standard method was used, the pretreatment bath having the following composition:

1.5 g/l of a stabilizer, 4 ml/l sodium hydroxide, 38° Bé, 0.5 g/l wetting agent and 5 ml/l hydrogen peroxide, 35%.

After the bleaching step the material was rinsed three times and subsequently neutralised by the addition of acetic acid.

Figure 3:
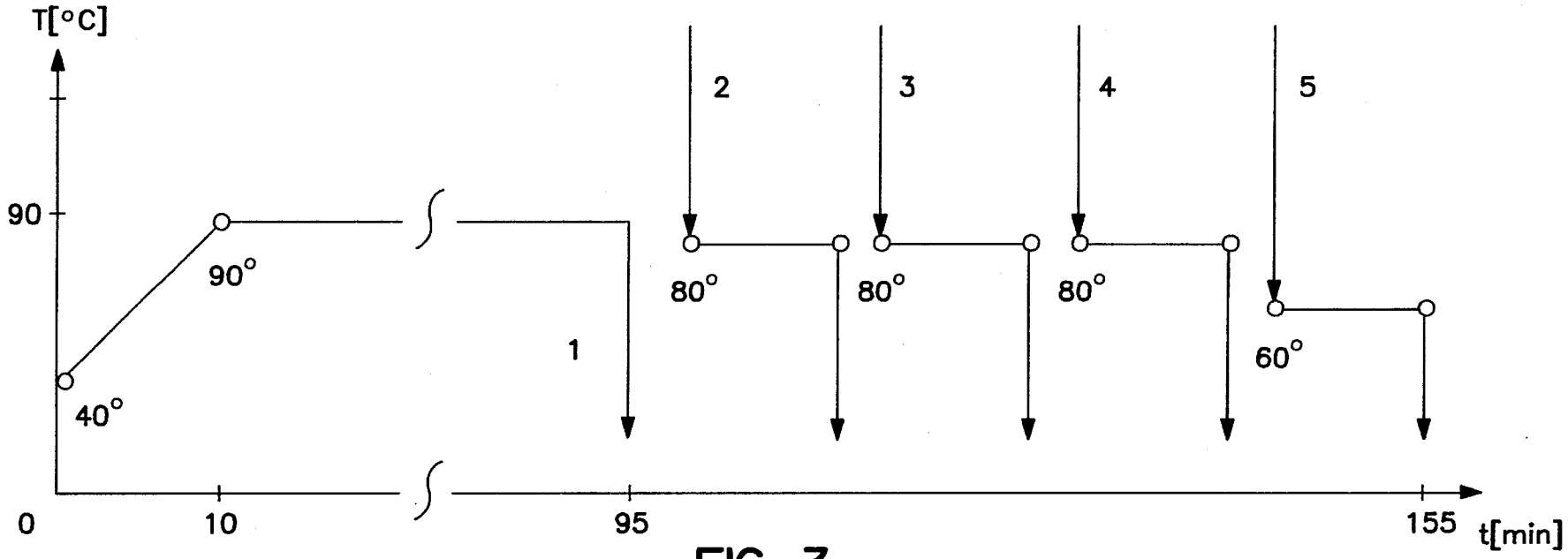
FIG. 3 PRIOR ART
FIG. 3 is a Temperature vs. Time graph for a standard boiling off/bleaching process for cotton tissue.

The temperature development in time during the treatment is depicted in FIG. 3, wherein the numeral 1 denotes draining off of pre-treatment bath, the numerals 2–4 denote first to third additions of rinsing liquor, and the numeral 5 denotes addition of neutralizing liquor (acetic acid). The total treatment time was 155 minutes.

At the same time the same type of tissue was treated by kier scouring and bleaching under the previously described conditions at 130° C. The pretreatment bath used for this treatment was differing from the previous one in that the hydrogen peroxide concentration was reduced by 30%. Furthermore, the required amount of hydrogen peroxide was added to the bath during the heating phase of the bath according to a progressive dosing scheme.

After the termination of the kier scouring/bleaching method cold washing water was added to the pretreatment bath in four separate portions, whereby the pretreatment bath now cooled down to 80° C. was drained off.

Immediately hereafter the bleached material was neutralised with acetic acid, the pH value being reduced in both cases to 4.5.

Figure 4:
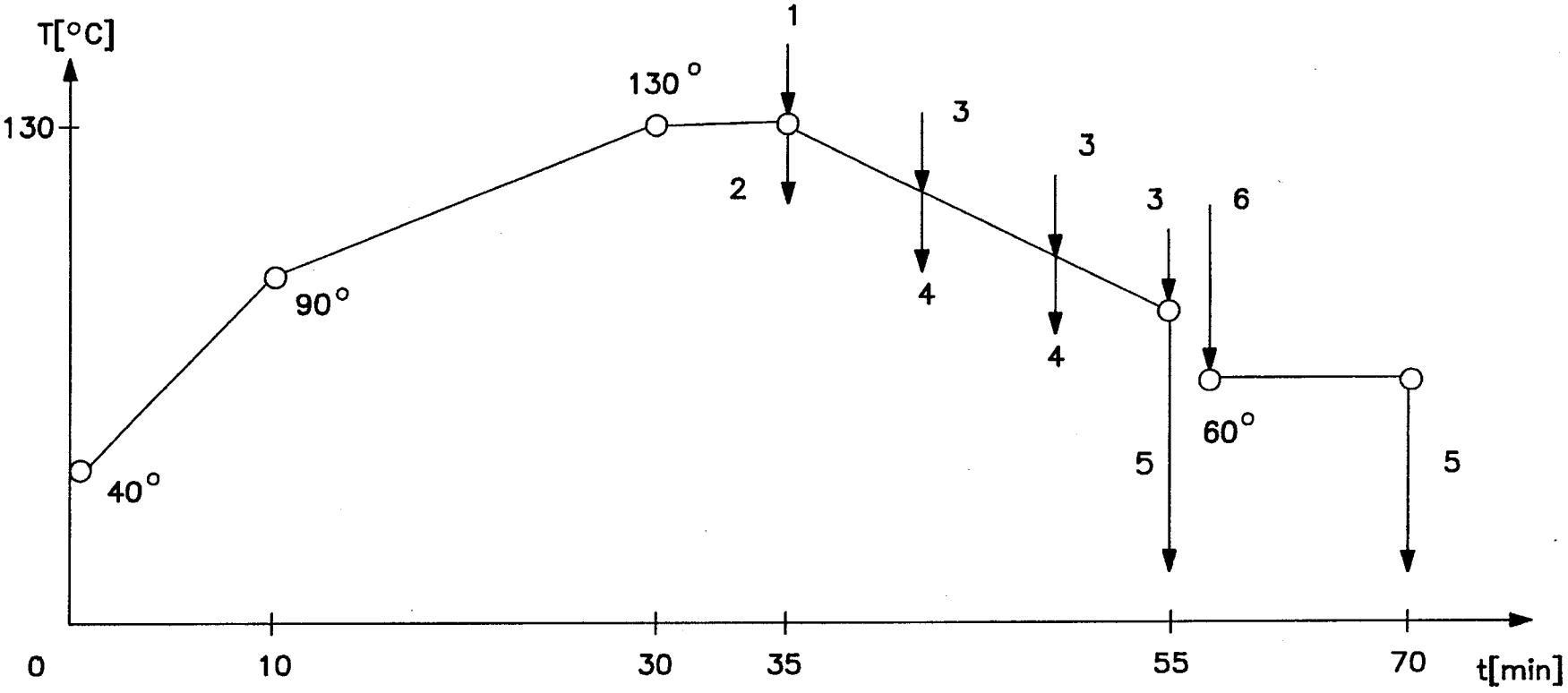
FIG. 4 is a Temperature vs. Time graph for an inventive embodiment of a boiling off/bleaching process for cotton tissue.

The development of the temperature is shown in FIG. 4, wherein the numbers 1 and 3 denote portion like addition of cold rinsing liquor, the numerals 2 and 4 denote portion-like draining off of soiled and heated liquor, wherein the numerals 5 denote draining off of bath, and the numerals 6 denotes addition of neutralizing liquor. The total treatment time was 70 minutes.

The degree of whiteness according to Berger, the DP value and the wettability were measured in both differently bleached materials. For the measurement of the wettability a water drop of defined dimension was brought onto the material and the time until disappearance was measured.

The results of these investigations are shown in table 2.

TABLE 2

| | degree of whiteness according to Berger | DP value | wettability, disappearance in sec |
|---|---|---|---|
| initial material | 42 | 2,520 | hydrophobic |
| initial material, bleached by standard method, 90° C. | 78 | 1,750 | 21 |
| initial material, progressive $H_2O_2$ addition, bleached at 130° C. | 93 | 2,380 | 4 |

The material bleached at 90° C. still contained some hulls and dead cotton, which was not the case in the material bleached at 130° C.

I claim:

1. A method for the pretreatment of a cotton-containing textile fabric, in which said textile fabric is treated in a pretreatment bath for a period of time at a temperature greater than 102° C., and wherein said textile fabric is subsequently rinsed by continuously diluting said pretreatment bath with a quantity of rinsing liquor at a temperature such that said textile fabric is cooled down at a cooling rate between 1° C./min and 3.5° C./min, to a temperature between 90° C. and 50° C., and wherein a quantity of said rinsing liquor is drained off as soiled liquor during said rinsing.

2. The method of claim 1, wherein said textile fabric is cooled down to a temperature between 80° C. and 60° C.

3. The method of claim 1, wherein said textile fabric is treated in said pretreatment bath at a temperature range between 120° C. and 140° C.

4. The method of claim 1, wherein the quantity of said rinsing liquor added for the dilution of the pretreatment bath is identical with the quantity of said soiled liquor drained off.

5. The method of claim 1, wherein said drained off soiled liquor is used to heat said rinsing liquor.

6. The method of claim 1, wherein said soiled liquor is drained off after said temperature between 90° C. and 50° C. has been reached.

7. The method of claim 1, wherein a further quantity of said rinsing liquor is added and a further quantity of said soiled liquor is drained off after said temperature between 90° C. and 50° C. is reached.

8. The method of claim 1, wherein said pretreatment bath contains at least one product selected from the group consisting of an alkali source, a bleaching chemical, a stabilizer, a wetting agent, a fluorescent brightener and a detergent.

9. The method of claim 8 wherein said alkali source is sodium hydroxide, said bleaching chemical is hydrogen peroxide, and said stabilizer is an organic stabilizer.

10. The method of claim 8, wherein said pretreatment bath contains between 0.5 ml/l and 5 ml/l sodium hydroxide, 1.5 ml/l and 10 ml/l hydrogen peroxide, 0.2 g/l and 3 g/l stabilizer and 0.1 g/l and 3 g/l wetting agent.

11. The method of claim 10, wherein said pretreatment bath further comprises between 0.1 g/l and 3 g/l detergent.

12. The method of claim 1, wherein said textile fabric is treated as a rope of fabric.

* * * * *